US006446558B1

(12) United States Patent
Peker et al.

(10) Patent No.: US 6,446,558 B1
(45) Date of Patent: Sep. 10, 2002

(54) SHAPED-CHARGE PROJECTILE HAVING AN AMORPHOUS-MATRIX COMPOSITE SHAPED-CHARGE LINER

(75) Inventors: Atakan Peker, Aliso Viejo; William L. Johnson, Pasadena, both of CA (US)

(73) Assignee: Liquidmetal Technologies, Inc., Lake Forest, CA (US)

( * ) Notice: Subject to any disclaimer, the term of this patent is extended or adjusted under 35 U.S.C. 154(b) by 0 days.

(21) Appl. No.: 09/796,736

(22) Filed: Feb. 27, 2001

(51) Int. Cl.[7] ..... F42B 1/02
(52) U.S. Cl. ..... 102/306; 102/307; 102/476
(58) Field of Search ..... 102/307, 306, 102/476

(56) References Cited

U.S. PATENT DOCUMENTS 4,327,642 A * 5/1982 Grosse-Benne et al. .... 102/307
4,551,287 A * 11/1985 Bethmann ..... 102/307 X
4,598,643 A * 7/1986 Skrocki ..... 102/307
4,958,569 A * 9/1990 Mandigo ..... 102/307 X
5,098,487 A * 3/1992 Brauer et al. ..... 102/307 X
5,331,895 A * 7/1994 Bourne et al. ..... 102/307
5,413,048 A * 5/1995 Werner et al. ..... 102/307
5,509,356 A * 4/1996 Renfro ..... 102/307
5,567,906 A * 10/1996 Reese et al. ..... 102/307 X
6,105,505 A * 8/2000 Jones ..... 102/364
6,152,040 A * 11/2000 Riley et al.

* cited by examiner

*Primary Examiner*—Peter A. Nelson
(74) *Attorney, Agent, or Firm*—Christie, Parker & Hale, LLP

(57) ABSTRACT

A shaped-charge projectile includes a container in the form of a hollow shell elongated parallel to a projectile axis, with the container having a front end and a back end. A shaped-charge liner is within the container and adjacent to the front end of the container. The shaped-charge liner is a composite material of fibers or particles of a solid reinforcement dispersed in a solid amorphous matrix. An explosive charge is positioned between the shaped-charge liner and the back end of the container. The shaped-charge liner is preferably prepared by infiltration or casting, and assembled with the other elements to make the shaped-charge projectile.

20 Claims, 4 Drawing Sheets

SHAPED-CHARGE PROJECTILE HAVING AN AMORPHOUS-MATRIX COMPOSITE SHAPED-CHARGE LINER

This invention relates to shaped-charge projectiles and, more particularly, to a shaped-charge liner made of fibers or particles of a reinforcement dispersed in a matrix comprising an amorphous metal.

BACKGROUND OF THE INVENTION

A shaped-charge projectile is used against armor and other hardened targets. It has an external appearance similar to a conventional round, but the internal structure is different. Behind the front end of a hollow-shell container is a metallic shaped-charge liner. Positioned further behind the metallic shaped-charge liner is an explosive charge. A detonator is in contact with the explosive charge. The projectile may also have a propulsion capability, or propulsion may be provided separately.

In operation, the shaped-charge projectile is propelled toward the target. Just prior to the projectile contacting the target, the detonator is fired to ignite the explosive charge. The force of the explosion is directed inwardly and forwardly, deforming the shaped-charge liner. The concentrated force of the explosion is so great and occurs in such a short period of time that the shaped-charge liner melts to the liquid or semi-liquid metallic state as it deforms. The resulting metallic jet of metal is forced forwardly against the target and achieves the penetration of the target. The shaped-charge liner does not penetrate the target in its solid form.

Thus, the shaped-charge projectile differs from an inert, heavy-mass penetrator in both its physical structure and its mode of operation. The heavy-mass penetrator relies upon its heavy mass and solid-state deformation behavior for its ability to penetrate the target, while the shaped-charge projectile penetrates the target in a liquefied form that is created and propelled forwardly by an explosion that occurs just as the projectile reaches its target. The physical principles that underlie the operation of conventional shaped-charge projectiles are completely different from those that underlie the operation of heavy-mass penetrators.

While operable, conventional shaped-charge projectiles have shortcomings in some applications and missions, and there is always a desire to improve an existing technology. There is therefore a need for an improved approach to the construction of shaped-charge projectiles. The present invention fulfills this need, and further provides related advantages.

SUMMARY OF THE INVENTION

The present invention provides an improved shaped-charge projectile. The present shaped-charge projectile utilizes the basic proven components of the shaped-charge projectile, but utilizes an improved shaped-charge liner material in either conventional or new physical configurations. The result is improved performance of the shaped-charge projectile.

In accordance with the invention, a shaped-charge projectile comprises a container in the form of a hollow shell elongated parallel to a projectile axis, with the container having a front end and a back end. A shaped-charge liner resides within the container adjacent to the front end of the container. The shaped-charge liner is a composite material made of a plurality of pieces of solid fibers or particles of a reinforcement dispersed in a matrix comprising an amorphous solid metal that may include some nanocrystalline metal. An explosive charge is positioned between the shaped-charge liner and the back end of the container. A detonator detonates the explosive charge, and a propulsion source may optionally be present in the projectile.

Preferably, the hollow shell is cylindrically symmetric about the projectile axis. It may have a generally conical nose, and a cylindrical rear portion continuous with the nose. The projectile may have other shapes as well, such as a flat-nosed hollow shell. The shaped-charge liner may be cylindrically symmetric about the projectile axis, or it may be asymmetric relative to the projectile axis.

The shaped-charge liner may have any operable shape, and a large number of shapes are known in the art for conventional shaped-charge projectile. In one configuration, the shaped-charge liner has the shape of a cone with a rearwardly pointing apex. In another, the shaped-charge liner is hemispherical, with its apex pointing rearwardly. (The term "shaped-charge liner" is a term of art and does not suggest that the shaped-charge liner lines the entire interior of the hollow shell of the projectile.)

The shaped-charge liner is formed of a composite material. The reinforcement phase desirably comprises from about 10 to about 95 percent by volume of the shaped-charge liner, and the balance is the matrix metal. The reinforcement is in the form of elongated fibers or more-equiaxed particles. Typical reinforcement metals include tungsten, niobium, tantalum, uranium, molybdenum, and copper, as well as alloys of each of these metals with other metals.

The matrix metal is an amorphous metal in its solid form. The matrix metal is preferably a bulk-solidifying amorphous metal which may be solidified to the desired shape of the shaped-charge liner. A preferred composition for the matrix metal, in atomic percent, is about 41 percent zirconium, about 14 percent titanium, about 12.5 percent copper, about 10 percent nickel, and about 22.5 percent beryllium.

The composite reinforcement/amorphous metal shaped-charge liner has important advantages as compared with a conventional monolithic metal shaped-charge liner or shaped-charge liner made of a composite material with a monolithic-metal matrix. The present composite reinforcement/amorphous metal shaped-charge liner does not work harden in the same manner as the conventional shaped-charge liner during the deformation period after the explosive is ignited and before the shaped-charge liner liquefies. Instead, it deforms more uniformly and nearly isotropically in compressive loading, to a large deformation strain. The result is that the shaped-charge liner achieves a large, predictable deformation prior to liquefaction.

A method for fabricating a shaped-charge projectile comprises the steps of providing a plurality of pieces of a reinforcement, providing a molten bulk-solidifying amorphous metal matrix alloy, and combining the reinforcement and the bulk-solidifying amorphous metal matrix alloy while the metal matrix alloy is molten to form a molten-matrix composite material. The reinforcement and the bulk-solidifying amorphous metal matrix alloy may be combined by any operable technique, such as infiltration, or mixing and casting. A shaped-charge liner is prepared from the molten-matrix composite material, with the step of preparing including the step of solidifying the molten matrix of the molten-matrix composite material to form a composite material of reinforcement in a solid amorphous alloy matrix. The method further includes providing other components of the shaped-charge projectile, and assembling the shaped-charge liner and the other components to form the shaped-charge projectile.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
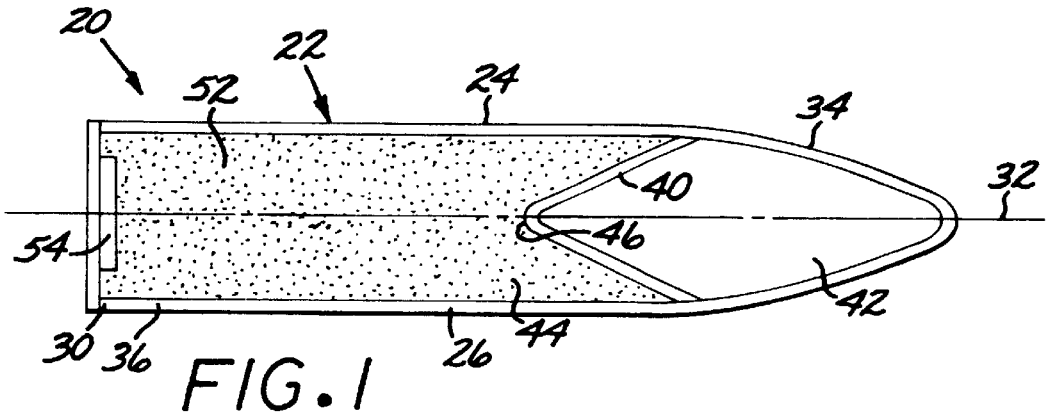
FIG. 1 is a longitudinal sectional view of a first embodiment of a shaped-charge projectile.
Figure 2:
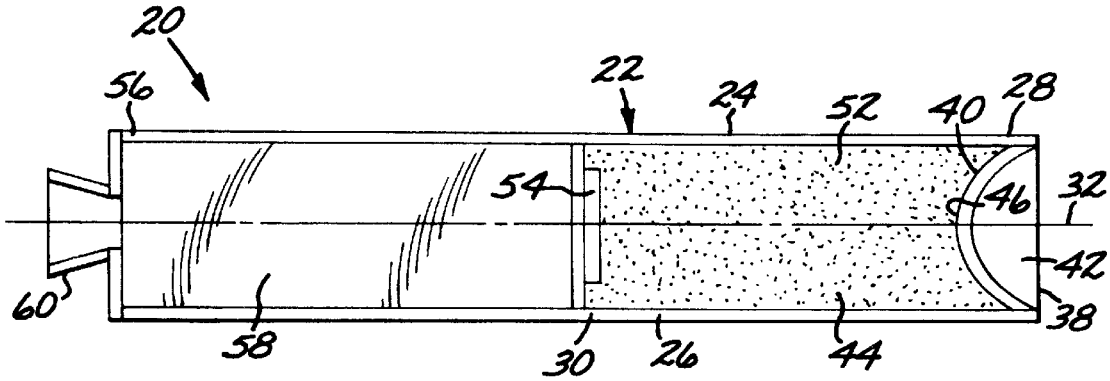
FIG. 2 is a longitudinal sectional view of a second embodiment of a shaped-charge projectile.

The present invention may be used in conjunction with any operable structure of a shaped-charge projectile. FIGS. 1 and 2 illustrate two embodiments of a suitable shaped-charge projectile 20, and the various features of these embodiments may be used together in any operable arrangement. In each case, the shaped-charge projectile 20 comprises a container 22 in the form of a hollow shell 24 with a sidewall 26, a front end 28, and a back end 30. The sidewall 26 of the hollow shell 24 is preferably elongated parallel to a projectile axis 32. The hollow shell 24 is preferably cylindrically symmetric about the projectile axis 32. In the embodiment of FIG. 1, the hollow shell 24 is aerodynamically shaped with a generally conical (which encompasses conical, ogival, and related shapes) nose 34, and a cylindrical rear portion 36 continuous with the nose 34. In the embodiment of FIG. 2, the hollow shell 24 is similar to that of FIG. 1 but has a flat nose 38.

The shaped-charge projectile 20 includes a shaped-charge liner 40 within the container 22 and adjacent to the front end 28 of the container 22. The shaped-charge liner 40 extends between the sidewalls 26 of the hollow shell 24 and is joined to the hollow shell 24. The shaped-charge liner 40 divides the hollow shell into a forward compartment 42 and a rearward compartment 44. In the embodiment of FIG. 1, the shaped-charge liner 40 has the shape of a cone with a rearwardly pointing apex 46 that points toward the back end 30. In the embodiment of FIG. 2, the shaped-charge liner 40 is a hemisphere with a rearwardly pointing apex 46. The shaped-charge liner 40 may be cylindrically (rotationally) symmetric about the projectile axis 32, or it may be cylindrically asymmetric about the projectile axis 32. There are many other known forms of shaped-charge projectiles, and the shaped-charge liner of the present approach is operable with these other forms as well.

Figure 3:
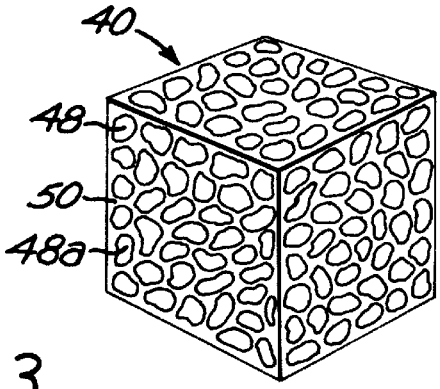
FIG. 3 is an enlarged perspective view of a first type of composite material which may be used in the shaped-charge liner.
Figure 4:
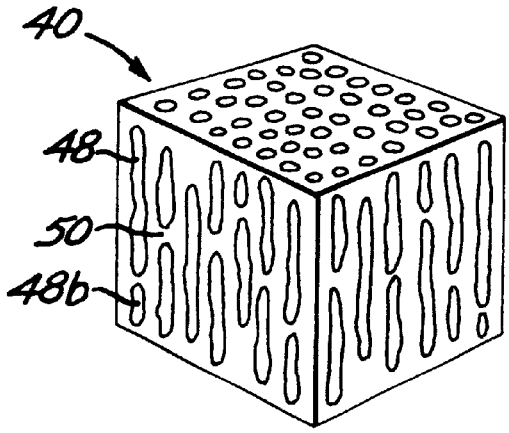
FIG. 4 is an enlarged perspective view of a second type of composite material which may be used in the shaped-charge liner.

Embodiments of the microstructure of the shaped-charge liner 40 are illustrated in FIGS. 3–4. The shaped-charge liner 40 is a composite material of a plurality of pieces 48 of a solid reinforcement in a matrix 50 of a solid matrix metal. (Three terms are used herein to describe the amorphous metal at various stages of its fabrication and service in the shaped-charge projectile. The "molten" amorphous metal refers to the readily flowable amorphous metal prior to its mixing with the reinforcement and also after mixing with the reinforcement but prior to solidification. In this "molten" state, the amorphous metal has a viscosity of less than about $10^{12}$ poise. The "solid" amorphous metal refers to the amorphous metal of the composite material after solidification, as used to form the freestanding shaped-charge liner 40, and also after detonation of the explosive charge but prior to the heating of the amorphous metal to a readily flowable state. In this "solid" state, the amorphous metal has a viscosity of equal to or greater than about $10^{12}$ poise. The "liquid" amorphous metal refers to the amorphous metal after the explosive has been detonated and the amorphous metal has heated to a temperature such that it is readily flowable. In this "liquid" state, the amorphous metal has a viscosity of less than about $10^{12}$ poise.)

The pieces 48 are either substantially equiaxed particles 48*a* (FIG. 3) or elongated fibers 48*b* (FIG. 4). The substantially equiaxed particles 48*a* are characterized by three orthogonal dimensions, wherein the ratio of the longest dimension to the shortest dimension (termed the aspect ratio) is no greater than about 2:1. The fibers 48*b* are characterized by three orthogonal dimensions, two of which are about the same. The longest dimension is much larger than the other two approximately equal dimensions, and the ratio of the longest dimension to the shortest dimension is greater than about 2:1, and preferably greater than about 10:1. Examples of fibers 48*b* include, but are not limited to, rods, wires, and whiskers. The reinforcement that comprises the pieces 48 is preferably a heavy metal selected from the group consisting of tungsten, niobium, tantalum, uranium, molybdenum, and copper, as well as alloys of each of these metals with other metals. The pieces 48 may be wholly substantially equiaxed particles 48*a*, wholly elongated fibers 48*b*, or a mixture of substantially equiaxed particles 48*a* and elongated fibers 48*b*. The pieces 48 of the reinforcement comprise from about 10 to about 95 percent by volume of the shaped-charge liner 40, and the balance is the matrix metal 50.

Figure 5:
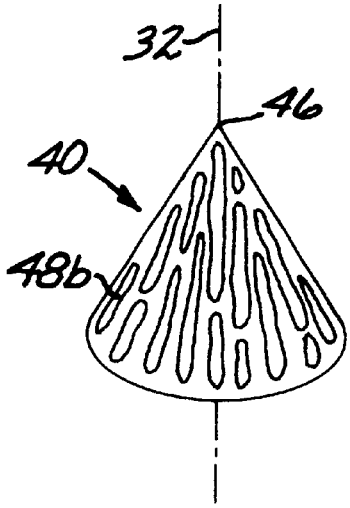
FIG. 5 is a schematic perspective view of a first fiber orientation which may be used in the shaped-charge liner.
Figure 6:
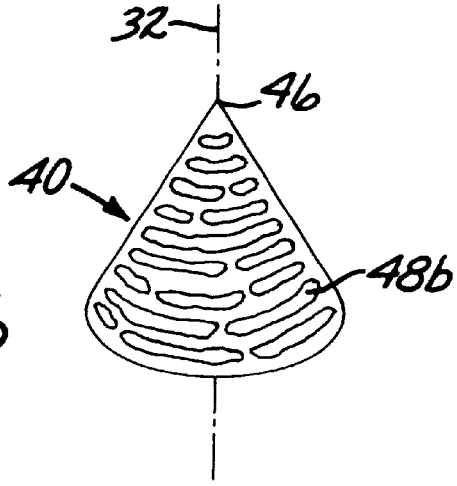
FIG. 6 is a schematic perspective view of a second fiber orientation which may be used in the shaped-charge liner.

In the case where the pieces 48 are fibers 48*b*, the fibers 48*b* may be arranged in any operable arrangement within the shaped-charge liner 40. Two possible arrangements are illustrated in FIGS. 5 and 6 for a conical shaped-charge liner 40. In FIG. 5, the fibers 48*b* lie parallel to a generator line that extends from the apex 46 and is tangent to the surface of the conical shaped-charge liner 40. In FIG. 6, the fibers 48*b* extend circumferentially around the surface of the conical shaped-charge liner 40 (i.e., perpendicular to the generator line), with each fiber 48*b* at a substantially constant distance from the apex 46. Other operable arrangements are possible as well.

The matrix is a solid amorphous metal. The amorphous matrix alloy material may be any alloy which may be cooled at a sufficiently high rate to retain the amorphous state at room temperature. Amorphous metals are known in the art, and are described, for example, in U.S. Pat. Nos. 5,288,344; 5,250,124; 5,032,196; and 5,618,359. In such amorphous metals, the metallic atoms are not arranged on a periodic lattice, as is the case for conventional crystalline metals. Operable amorphous metals include metals that require high cooling rates from the melt, on the order of $10^{6\circ}$ C. per second, to retain the amorphous state as a solid, as well as metals that may be cooled from the melt at much lower rates, on the order of 500° C. per second or less, to retain the amorphous state as a solid. The latter metals, termed "bulk-solidifying amorphous metals", are preferred for use in the present invention, because articles having thicknesses greater than about 0.25 millimeters may be readily fabricated and because fabrication techniques may be used which may not be used for amorphous alloys requiring higher cooling rates. It is more difficult to fabricate such articles from the amorphous metals that require much higher cooling rates to retain the amorphous state as a solid. The above-listed four patents describe compositions of bulk-solidifying amorphous metals. Operable amorphous metals also include metals which are fabricated by other techniques, such as powder metallurgical or electrodeposition techniques.

One preferred bulk-solidifying amorphous alloy family has a composition, in atom percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent. A most preferred metal alloy of this group has a composition, in atomic percent, of about 60 percent zirconium about 15 percent aluminum, and about 25 percent nickel.

Another preferred bulk-solidifying amorphous alloy family has a composition, in atom percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent. A substantial amount of hafnium may be substituted for some of the zirconium and titanium, aluminum may be substituted for the beryllium in an amount up to about half of the beryllium present, and up to a few percent of iron, chromium, molybdenum, or cobalt may be substituted for some of the copper and nickel. This bulk-solidifying alloy is known and is described in U.S. Pat. No. 5,288,344. A most preferred such metal alloy material of this family, termed Vitreloy™-1, has a composition, in atomic percent, of about 41 percent zirconium, 14 percent titanium, 10 percent nickel, 12.5 percent copper, and 22.5 percent beryllium. Other bulk-solidifying alloy families, such as those having even high contents of aluminum and magnesium, are operable but less preferred.

The rearward compartment 44, between the shaped-charge liner 40 and the back end 30 of the container 22, contains an explosive charge 52. The explosive may be of any operable type. Preferably, a detonator 54 is positioned in the rearward compartment 44 to controllably detonate the explosive charge 52 so that it bums from its rearward end forwardly.

The projectile 20 of FIG. 1 is not itself powered, and is fired from a gun. The projectile 20 of FIG. 2 is self-propelled, and may be fired from a gun or a rocket launcher. The projectile 20 of FIG. 2 includes a propellant chamber 56 at the rearward end of the projectile 20 and which is preferably formed as a rearward extension of the sidewall 26. A propellant 58, preferably a solid propellant, fills the propellant chamber 56. The propellant 58, when ignited, produces gases which expand rearwardly through an optional expansion nozzle 60 and propel the projectile 20 forwardly.

In the present approach, the presence of the reinforcement serves to improve the deformation behavior of the amorphous material to achieve greater deformation and uniformity of deformation in the solid state than possible in the absence of the reinforcement. The result is improved performance of the liquid metal that is formed subsequent to the detonation of the explosive charge.

Figure 7:
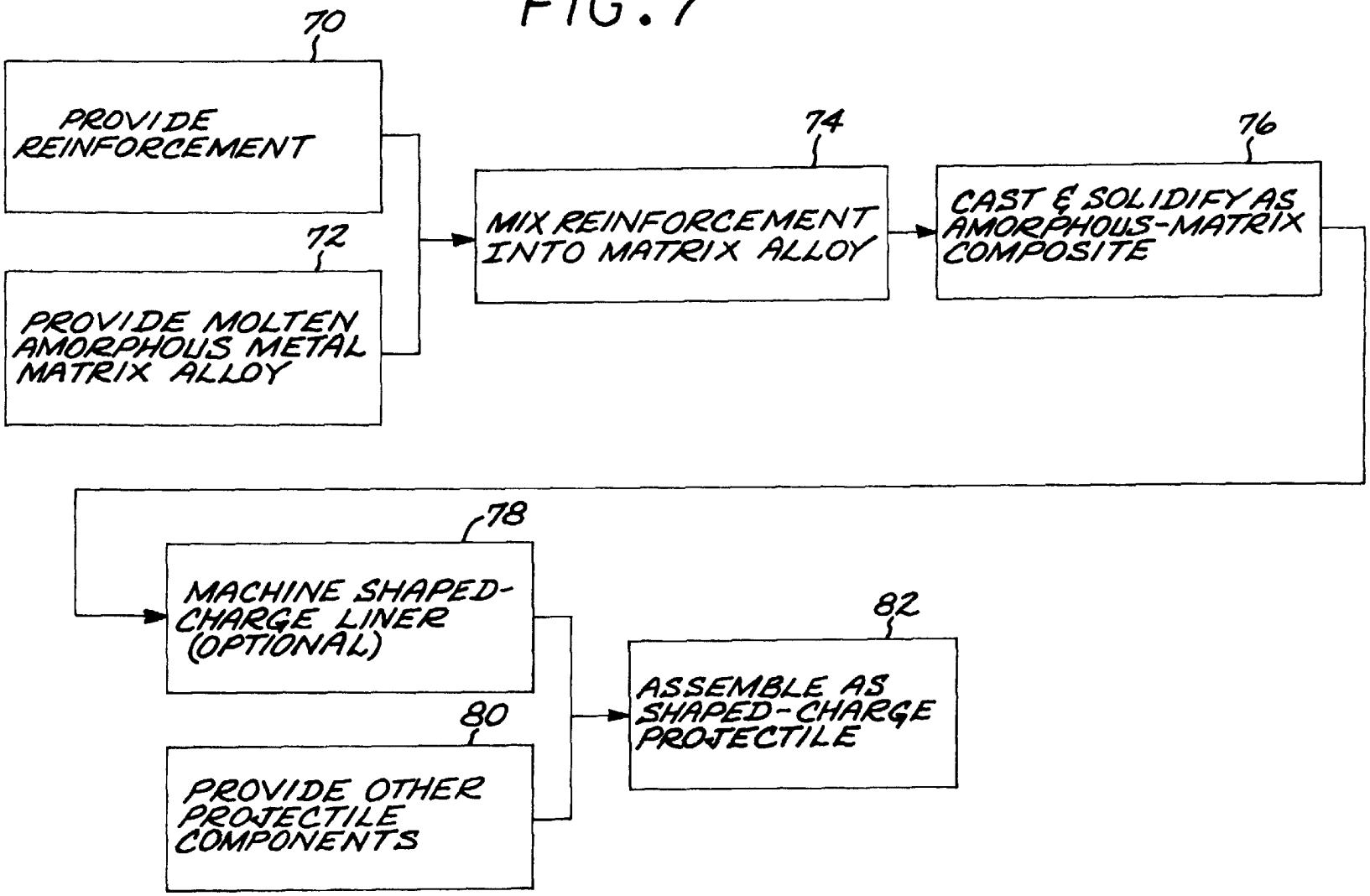
FIGS. 7 and 8 are block flow diagrams of two approaches to fabricating a shaped-charge projectile using a shaped-charge liner made of a composite of a reinforcement in a bulk-solidifying amorphous alloy.
Figure 8:
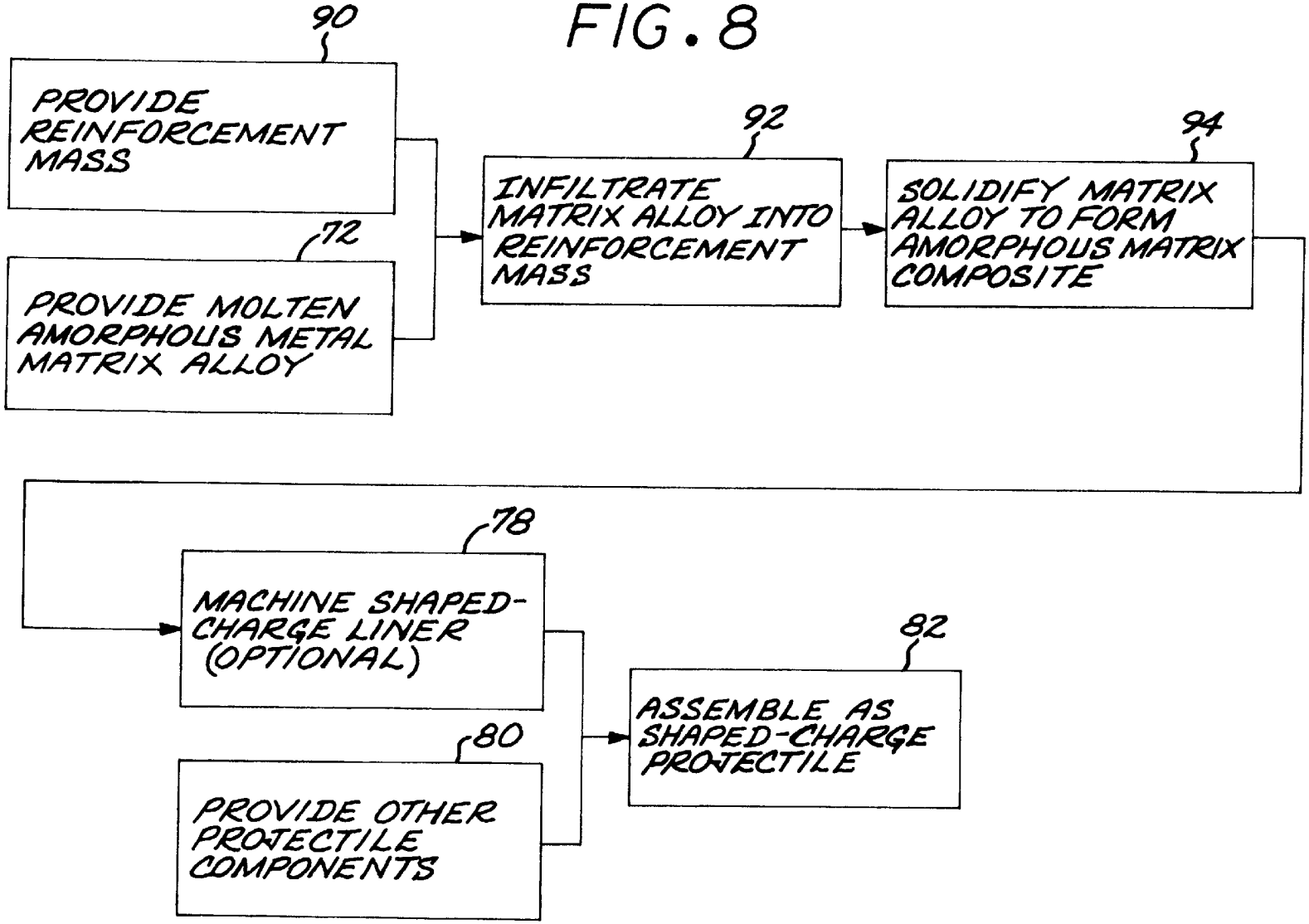

FIGS. 7 and 8 depict fabrication methods for shaped-charge projectiles that incorporate a shaped-charge liner made of a composite material of pieces of solid reinforcement in a bulk-solidifying amorphous alloy matrix. These fabrication technologies require the use of the bulk-solidifying amorphous alloy as distinct from an amorphous alloy that requires a cooling rate of $10^{6\circ}$ C. per second or more. The latter amorphous alloys are typically prepared by rapidly cooling the amorphous material against a chilled wheel or disk, producing thin plates or ribbons. They are not suitable for combination techniques that distribute the reinforcement throughout the amorphous alloy matrix, such as infiltration or composite bulk casting.

In the approach of FIG. 7, the reinforcement is provided, numeral 70, and the amorphous bulk-solidifying amorphous matrix alloy is provided in a heated, molten form, numeral 72. The reinforcement is mixed into the molten amorphous matrix alloy, numeral 74, to form a free-flowing composite mass. The mixture is cast into a mold and solidified as an amorphous-matrix composite material, numeral 76. Casting may be by any operable approach, including mold casting, die casting, and the like. The mixture is preferably cast to exactly the desired form of the shaped-charge liner or as close to that shape as possible. Some optional machining of the shaped-charge liner may be required, numeral 78. The other components of the projectile are provided, numeral 80. These other components include the container 22, the explosive charge 52, the detonator 54, and any propellant 58 that may be used, as well as other optional components. The shaped-charge liner 40 and the other projectile components are assembled together to form the shaped-charge projectile, numeral 82.

The approach of FIG. 8 produces the shaped-charge liner by an infiltration approach. In this approach, steps 72, 78, 80, and 82 are as discussed in relation to FIG. 7, and that discussion is incorporated here. In the method of FIG. 8, the reinforcement is provided as a reinforcement mass, numeral 90. The molten amorphous matrix alloy of step 72 is infiltrated into the reinforcement mass, numeral 92, and then solidified to form the amorphous-matrix composite material, numeral 94. The remainder of the steps are as described previously.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A shaped-charge projectile comprising a container in the form of a hollow shell elongated parallel to a projectile axis, the container having a front end and a back end;

a shaped-charge liner within the container and adjacent to the front end of the container, the shaped-charge liner being a composite material of a plurality of pieces of a solid reinforcement in a form selected from the group consisting of fibers and particles dispersed in a matrix comprising a solid amorphous metal; and an explosive charge positioned between the shaped-charge liner and the back end of the container.

2. The shaped-charge projectile of claim 1, wherein the hollow shell is cylindrically symmetric about the projectile axis, and wherein the shaped-charge liner is cylindrically symmetric about the projectile axis.

3. The shaped-charge projectile of claim 1, wherein the shaped-charge liner has the shape of a cone with a rearwardly pointing apex.

4. The shaped-charge projectile of claim 1, wherein at least some of the reinforcement is in the form of fibers.

5. The shaped-charge projectile of claim 1, wherein at least some of the reinforcement is in the form of particles.

6. The shaped-charge projectile of claim 1, wherein the reinforcement is a metal selected from the group consisting of tungsten, niobium, tantalum, uranium, molybdenum, and copper, as well as alloys of each of these metals with other metals.

7. The shaped-charge projectile of claim 1, wherein the matrix is substantially fully amorphous.

8. The shaped-charge projectile of claim 1, wherein the matrix comprises some nanocrystalline material.

9. The shaped-charge projectile of claim 1, wherein the matrix has a composition, in atomic percent, of about 41 percent zirconium, about 14 percent titanium, about 12.5 percent copper, about 10 percent nickel, and about 22.5 percent beryllium.

10. The shaped-charge projectile of claim 1, wherein the matrix is a bulk-solidifying amorphous alloy.

11. The shaped-charge projectile of claim 1, wherein the pieces of the reinforcement comprise from about 10 to about 95 percent by volume of the shaped-charge liner, and the balance is the matrix.

12. The shaped-charge projectile of claim 1, further including a detonator positioned to controllably detonate the explosive charge.

13. A method for fabricating a shaped-charge projectile, comprising the steps of providing a plurality of pieces of a reinforcement;

providing a molten bulk-solidifying amorphous metal matrix alloy;

combining the reinforcement and the bulk-solidifying amorphous metal matrix alloy while the metal matrix alloy is molten to form a molten-matrix composite material;

preparing a shaped-charge liner from the molten-matrix composite material, the step of preparing including the step of solidifying the molten matrix of the molten-matrix composite material to form a composite material of reinforcement in a solid amorphous alloy matrix;

providing other components of the shaped-charge projectile; and assembling the shaped-charge liner and the other components to form the shaped-charge projectile.

14. The method of claim 13, wherein the step of combining includes the step of mixing reinforcement and the bulk-solidifying amorphous metal matrix alloy to form a free-flowing mass, and casting the molten-matrix composite material into a mold.

15. The method of claim 13, wherein the step of combining includes the step of infiltrating the molten-matrix composite material into mass of the reinforcement.

16. The method of claim 13, wherein the step of preparing includes the additional step, after the step of solidifying, of machining the composite material of reinforcement in a solid amorphous alloy matrix.

17. A shaped-charge projectile comprising a container in the form of a hollow shell elongated parallel to a projectile axis, the container having a front end and a back end;

a shaped-charge liner within the container and adjacent to the front end of the container, the shaped-charge liner comprising a solil bulk-solidifying amorphous metal mixed with a solid reinforcement; and an explosive charge positioned between the shaped-charge liner and the back end of the container.

18. The shaped-charge projectile of claim 1, wherein at least some of the reinforcement is in the form of fibers.

19. The shaped-charge projectile of claim 1, wherein at least some of the reinforcement is in the form of particles.

20. The shaped-charge projectile of claim 1, wherein the matrix is substantially fully amorphous.

* * * * *